US006903687B1

(12) United States Patent
Fink et al.

(10) Patent No.: US 6,903,687 B1
(45) Date of Patent: Jun. 7, 2005

(54) FEED STRUCTURE FOR ANTENNAS

(75) Inventors: Patrick W. Fink, Fresno, TX (US); Andrew W. Chu, Friendswood, TX (US); Justin A. Dobbins, Houston, TX (US); Greg Y. Lin, Houston, TX (US)

(73) Assignee: The United States of America as represented by the United States National Aeronautics and Space Administration, Washington, DC (US)

( * ) Notice: Subject to any disclaimer, the term of this patent is extended or adjusted under 35 U.S.C. 154(b) by 177 days.

(21) Appl. No.: 10/449,905

(22) Filed: May 29, 2003

(51) Int. Cl.[7] ..... H01Q 1/38

(52) U.S. Cl. ..... 343/700 MS; 343/830; 333/126

(58) Field of Search ..... 343/700 MS, 830, 343/846, 853; 333/33, 260

(56) References Cited

U.S. PATENT DOCUMENTS

| | | | | |
|---|---|---|---|---|
| 4,603,926 A | | 8/1986 | Nesbit et al. | |
| 4,796,432 A | | 1/1989 | Fixsen et al. | |
| 4,995,815 A | | 2/1991 | Buchanan et al. | |
| 5,394,119 A | | 2/1995 | Pleva et al. | |
| 5,499,033 A | | 3/1996 | Smith | |
| 5,559,523 A | | 9/1996 | Smith et al. | |
| 5,606,870 A | | 3/1997 | Lester | |
| 5,614,915 A | | 3/1997 | Webb | |
| 5,661,494 A | | 8/1997 | Bondyopadhyay | |
| 5,729,237 A | | 3/1998 | Webb | |
| 5,749,243 A | | 5/1998 | Lester | |
| 5,886,671 A | | 3/1999 | Riemer et al. | |
| 5,943,015 A | | 8/1999 | Webb | |
| 5,959,514 A | | 9/1999 | Smith et al. | |
| 5,986,519 A | | 11/1999 | Kellett et al. | |
| 6,119,465 A | | 9/2000 | Mullens et al. | |
| 6,211,824 B1 | * | 4/2001 | Holden et al. | 343/700 MS |
| 6,285,325 B1 | * | 9/2001 | Nalbandian et al. | 343/700 MS |
| 6,292,141 B1 | * | 9/2001 | Lim | 343/700 MS |
| 6,359,588 B1 | | 3/2002 | Kuntzsch | |
| 6,374,618 B1 | | 4/2002 | Lak | |
| 6,442,948 B1 | | 9/2002 | Takeda | |
| 6,483,464 B2 | * | 11/2002 | Rawnick et al. | 343/700 MS |
| 6,501,970 B2 | | 12/2002 | Heise et al. | 505/163 |
| 6,639,558 B2 | * | 10/2003 | Kellerman et al. | 343/700 MS |
| 2002/0037814 A1 | | 3/2002 | Heise et al. | 505/100 |
| 2002/0147242 A1 | | 10/2002 | Salyer et al. | 521/50 |
| 2004/0090369 A1 | * | 5/2004 | McCarrick | 343/700 MS |

* cited by examiner

*Primary Examiner*—Tan Ho
(74) *Attorney, Agent, or Firm*—Theodore U. Ro

(57) ABSTRACT

A novel feed structure, for an antenna having a resonant electric field structure, comprising a patch element, an integrated circuit attached to the patch element, at least one inner conductor electrically connected to and terminating at the integrated circuit on a first end of the at least one inner conductor, wherein the at least one inner conductor extends through and is not electrically connected to the patch element, and wherein the at least one inner conductor is available for electrical connectivity on a second end of the at least one inner conductor, and an outer conductor electrically connected to and terminating at the patch element on a first end of the outer conductor, wherein the outer conductor is available for electrical connectivity on a second end of the outer conductor, and wherein the outer conductor concentrically surrounds the at least one inner conductor from the second end of the at least one inner conductor available for electrical connectivity to the first end of the outer conductor terminating at the patch element.

70 Claims, 5 Drawing Sheets

FEED STRUCTURE FOR ANTENNAS

GOVERNMENT INTERESTS

Origin of the Apparatus

The methods described herein were made by employee(s) under contract with the United States Government and may be manufactured and used by or for the Government of the United States of America for governmental purposes without the payment of any royalties thereon or therefor.

BACKGROUND

Patch antennas may comprise, as an example, one or more conductive patch elements supported relative to a ground plane and radiating in a direction substantially perpendicular to the ground plane. For the purposes herein, the word "radiate" or any form thereof is defined as transmitting electromagnetic waves, receiving electromagnetic waves, or both. Conveniently, patch antennas may be formed by employing printed circuit techniques and a dielectric substrate may have a patch printed upon it in a similar fashion to the printing of microstrip feed lines employed in some layered antennas. Patch antennas are versatile in terms of possible geometries that make them applicable for many different configurations. For example, a patch antenna's shape may be of low profile and rectilinear in nature and thus, its planar structure can take advantage of printed circuit technology. Other advantages may include low weight, low volume, and low fabrication costs. Traditional disadvantages may include a narrow bandwidth, half plane radiation, and a limitation on the maximum gain.

For modern telecommunications applications, the patch antenna's traditional advantages usually outweigh the traditional disadvantages. Apart from the electrical performance of an antenna other factors need to be taken into account, such as size, weight, cost, and ease of construction of the antenna. Depending on the requirements, an antenna can be either a single radiating element or an array of like radiating elements. With the increasing deployment of wireless mobile communication devices, an increasing number of antennas are required for the deployment of mobile access systems. Such antennas are required to be both inexpensive and easy to produce.

As stated earlier, a traditional disadvantage of the patch antenna is its inherent narrow bandwidth. Many methods have been proposed to improve the bandwidth, and these include, as examples, the addition of parasitic patches, either laterally or vertically, the use of a thick dielectric substrate, and the cutting of apertures.

A common microstrip patch antenna has a microstrip feed cut-in at the optimum feed point. Patches having such cut-ins, however, do not necessarily provide good crosspolarization performance. Also, circular polarization is difficult to achieve due to perturbations caused by the inset microstrip lines. It is therefore very important to minimize parasitic effects, such as the aforementioned perturbations, of the feed while maintaining simple manufacturability.

Simplification of circuits that interface with the radiating elements is one way to achieve the goals of decreased size, decreased weight, ease of manufacture, and lowered costs. Power divider, filter, and low noise amplifier circuits are examples of structures that microwave and radio frequency (RF) designers often attempt to integrate with the antenna element. Integration with the antenna element usually results in smaller overall packaging and enhanced system performance. However, the packaging associated with common microwave circuits, for example, makes this integration very difficult when a common coaxial probe feed is used. Thus, it has been an objective of antenna designers to simplify the integration of circuits with the radiating element.

A typical antenna 16 using a coaxial cable is shown in FIG. 1A. An outer conductor 5 of a coaxial cable is terminated through a connector 6 to an antenna ground plane 3. A small clearance 7 in the ground plane 3 permits an inner conductor 4 to extend through a substrate 1 and protrude through a patch element 2, where the inner conductor 4 may be electrically bonded to the topside of the patch element 2. The clearance 7 in the ground plane 3 is created so that the inner conductor is not shorted to the ground plane 3. In this example, the substrate 1 is formed of a material with a predetermined dielectric constant. The patch element 2 is printed on top of the substrate 1. However, the substrate can simply be air, as is shown in FIG. 1B. FIG. 1B illustrates a patch antenna that primarily consists of a rectangular patch element mounted over a ground plane in addition to a coaxial cable. The mounting means may consist of nonconductive spacers, such as bolts, nuts, and washers comprised of nylon or similar material.

FIG. 2 illustrates a layered antenna 17 with an integrated stripline circuit in the form of a two-layer structure. The first end of a probe feed 18 protrudes through a patch element 8 and may be electrically bonded on the topside of the patch element 8, while the second end of the probe feed 18 protrudes through a stripline ground plane 11 and may be electrically bonded to a middle circuit layer 12 between a first dielectric layer 19 and a second dielectric layer 20. The stripline ground plane 11 surrounds the first dielectric layer 19 and the second dielectric layer 20. The probe feed 18 extends through a substrate 9 and ground plane 10. This stripline ground plane 11 is electrically connected to the ground plane 10. A first clearance 21 in the ground plane 10 and a second clearance 22 in the stripline ground plane 11 are created so that the probe feed 18 is not shorted to the ground plane 10, stripline ground plane 11, or both. An inner conductor 15 of a coaxial cable protrudes through the stripline ground plane 11 and may be electrically bonded to the middle circuit layer 12. A third clearance 23 in the stripline ground plane 11 is created so that the inner conductor 15 is not shorted to the stripline ground plane 11. An outer conductor 14 of the coaxial cable terminates at the stripline ground plane 11 by a connector 13. The difficulty with this design stems from the desire to provide an interface for the inner conductor 15 and the probe feed 18 as illustrated while connecting the top and bottom stripline layers in a reliable fashion. Some of these limitations may be overcome using modem plated thru-hole technology. However, unintentional parasitics at the interface between the integrated circuit and the antenna element often thwart the intended function of the integration circuit, the antenna element or both. Therefore, as a precursor to fabrication using plated thru-holes, a prototype is highly desirable in which (a) the interfaces closely represent, in the way of electromagnetic coupling, the assembly when fabricated with plated thru-holes, and (b) features of the generic integrated circuit can be readily altered or tuned in situ. Many solutions to this problem are unreliable due to electrically bonded (e.g., solder) joints that are either blind or nearly blind, to coupled lines whose relative positioning is not visible, and to joints between the probe feed and the surface to which it is bonded.

The present invention seeks to provide a novel feed structure incorporated into an antenna, which overcomes or reduces the aforementioned problems.

Description

DETAILED DESCRIPTION

The novel feed structure incorporated in an antenna will now be described more fully hereinafter with reference to the accompanying drawings, in which embodiments of a novel feed structure and antenna are shown. The novel feed structure and antenna may, however, be embodied in many different forms and should not be construed as limited to the embodiments set forth herein; rather, these embodiments are provided so that this disclosure will be thorough, complete, and will fully convey the scope of the antenna to those skilled in the art. Like numbers refer to like elements throughout.

The term "about" as used herein may be applied to modify any quantitative representation that could permissibly vary without resulting in a change in the basic function to which it is related. For example, a quantitative dielectric constant as disclosed herein may permissibly be different than the precise value if the basic function to which the dielectric constant is related does not change. For the purposes herein, the term "device" is used to mean any device that can send electromagnetic signals, receive electromagnetic signals, or both. For example, a device may be a transmitter, receiver, or transceiver. Further, a device includes the means for electrically connecting the device to an antenna, such as (for example) a coaxial cable and connector. For the purposes herein, the term "transferring electrical energy from a device to a patch element and integrated circuit or vice versa or both" is used to mean: for transmitting electromagnetic energy, transferring electrical energy from a device to an integrated circuit followed by a transfer of electrical energy from the integrated circuit to a patch element; for receiving electromagnetic energy, transferring electrical energy from a patch element to an integrated circuit followed by a transfer of electrical energy from the integrated circuit to a device; or for simultaneously transmitting and receiving electromagnetic energy, transferring electrical energy from a device to an integrated circuit followed by a transfer of electrical energy from the integrated circuit to a patch element and transferring electrical energy from a patch element to an integrated circuit followed by a transfer of electrical energy from the integrated circuit to a device. For the purposes herein, the term "available for electrical connectivity" is used to mean one end of a feed means, line, cable, or conductor is available to be electrically connected to a yet to be determined or predetermined device.

Figure 1A:
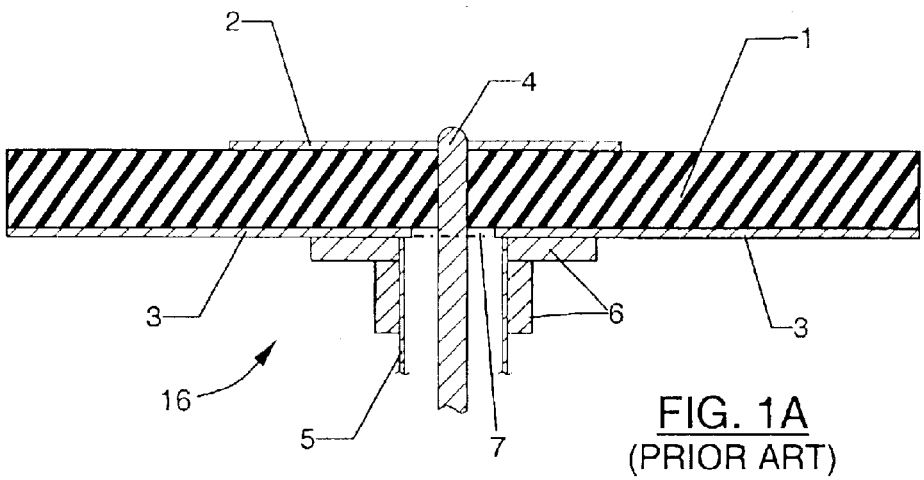
FIG. 1A (PRIOR ART)
FIG. 1A. is a cross sectional view of a common antenna configuration.
Figure 1B:
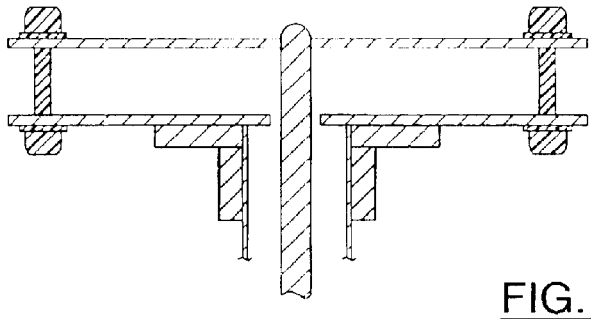
FIG. 1B (PRIOR ART)
FIG. 1B. is a cross section view of a common antenna configuration wherein the substrate is air.
Figure 2:
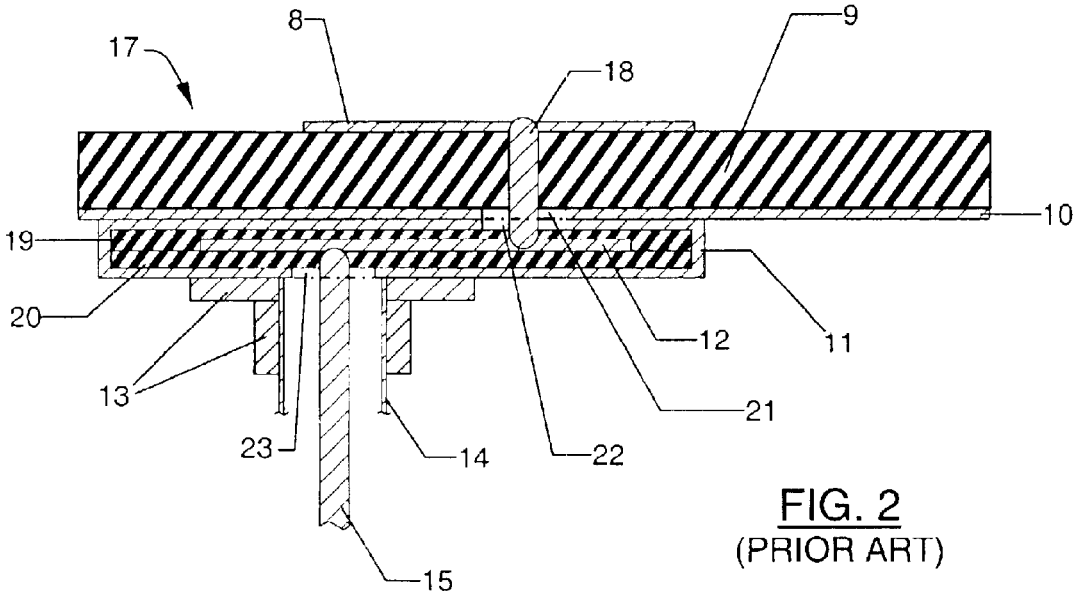
FIG. 2 (PRIOR ART)
FIG. 2. is cross sectional view of an integrated two-layer structure antenna configuration.
Figure 3A:
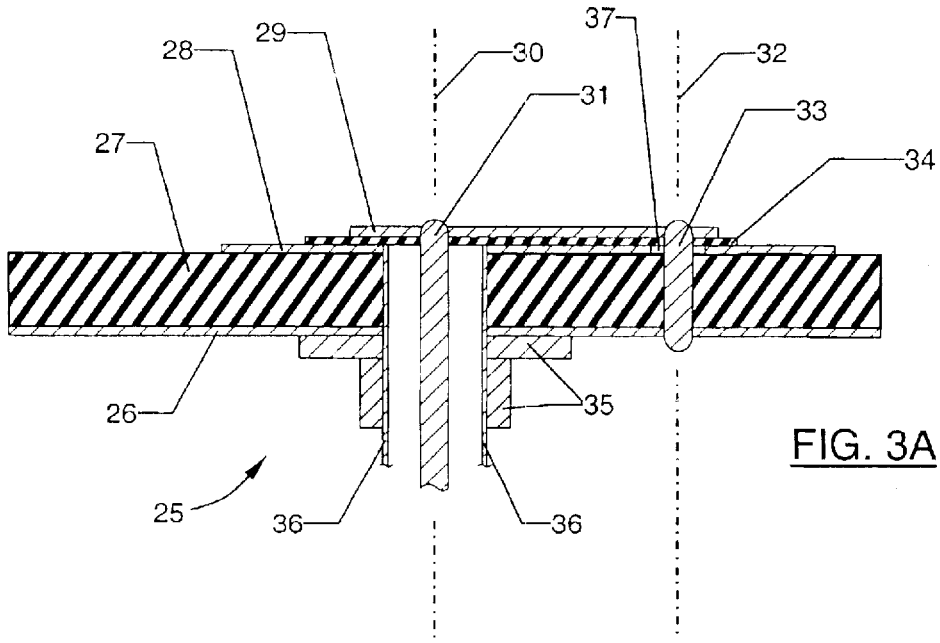
FIG. 3A. is a cross sectional view of one embodiment of an antenna utilizing an electrical connection means and a novel feed structure.
Figure 6:
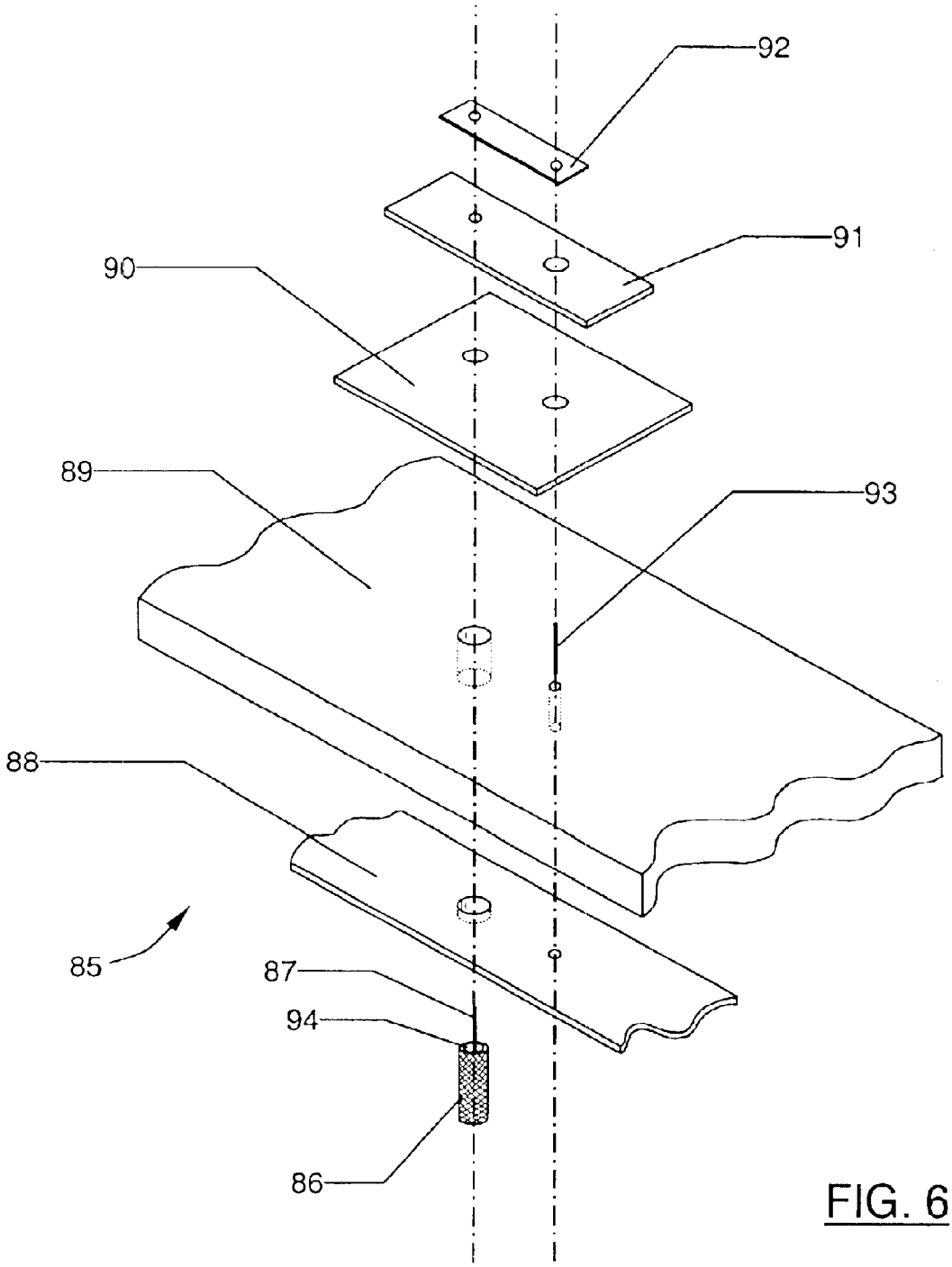
FIG. 6 is an exploded, perspective view of another embodiment of an antenna utilizing an electrical connection means and a novel feed structure.

Referring now to the drawings, and in particular to FIG. 3A, there is shown a first embodiment of an antenna 25, incorporating a novel feed structure, formed of a substrate 27, patch element 28, ground plane 26, an integrated circuit formed of a laminate layer 34 and a circuit layer 29, an electrical connection means 33, and a feed means, wherein the feed means is formed of an outer conductor 36 and an inner conductor 31. One embodiment of a novel feed structure comprises a feed means, patch element, and integrated circuit in the configuration illustrated in FIG. 3A. Further details relative to the interconnectivity of these elements are provided below. FIG. 6 illustrates an exploded perspective view of a similar embodiment of an antenna 85. In FIG. 6, there is shown a feed means, wherein the feed means is formed of an outer conductor 86 and an inner conductor 87 separated by a dielectric spacer 94; a ground plane 88; a substrate 89; a patch element 90; an integrated circuit formed of a laminate layer 91 and a circuit layer 92; and an electrical connection means 93.

With continued reference to FIG. 3A, the substrate 27 has a predetermined dielectric constant. In an embodiment, the dielectric constant may be from about 1 to about 200. In another embodiment, the substrate 27 may have an ellipsoidal, rectilinear, arbitrary, or asymmetrical cross-sectional shape with a predetermined thickness. In a further embodiment, the substrate may be air. Therefore, another embodiment of an antenna (not shown) is comprised of a patch element, integrated circuit, a ground plane, and a feed means formed of at least one outer conductor and at least one inner conductor. In this embodiment, the at least one inner conductor is electrically connected to and terminates at the integrated circuit on a first end of the at least one inner conductor but is not electrically connected to the patch element. The second end of the at least one inner conductor is available for electrical connectivity. Further, in this embodiment, at least one outer conductor terminates at the patch element on a first end of at least one outer conductor, at least one outer conductor is electrically connected to the patch element, and at least one outer conductor is electrically connected to the ground plane, wherein a second end of at least one outer conductor is available for electrical connectivity. The at least one outer conductor of the feed means serves as a mechanical standoff in addition to their stated electrical purpose.

With continued reference to FIG. 3A, there is shown a patch element 28, which is attached to the substrate 27. In the embodiment illustrated in FIG. 3A, the patch clement 28 is attached to the top surface of the substrate 27. The patch element 28 is attached to the substrate 27 via diffusion bonding means, electro-deposition means, standard printed circuit means, etching means, adhesive means, mechanical attachment means (e.g., non-conductive fasteners), or plating means on the top surface of the substrate 27. In a second embodiment (not shown), a patch element may be attached to the top surface of a substrate by embedding the patch element in the top surface of the substrate. In a third embodiment (not shown), a patch element may be embedded in the top surface of a substrate wherein the top surface of the patch element may be flush with the top surface of the substrate. In a fourth embodiment (not shown), wherein the substrate is air, a patch element may be mounted to a ground plane by non-conductive fasteners in such a manner to separate the patch element and ground plane at a predetermined distance. In one embodiment, the patch element 28 is comprised of a first conductive material. In a second embodiment, the first conductive material may be comprised of a conductive metal or alloy. In a third embodiment, the first conductive material may be selected from a group consisting of aluminum, copper, brass, gold, silver, tin, and nickel. In an embodiment, the patch element 28 has an ellipsoidal, rectilinear, arbitrary, or asymmetrical cross-sectional shape with a predetermined thickness. In the embodiment illustrated in FIG. 3A, a first clearance 37 in the patch element 28 is created such that a short circuit does not exist between the electrical connection means 33 and patch element 28.

With continued reference to FIG. 3A, there is shown a ground plane 26, which is attached to the substrate 27, wherein the ground plane 26 is comprised of a second conductive material. In the embodiment illustrated in FIG. 3A, the ground plane 26 is attached to the bottom surface of the substrate 27. The ground plane 26 is attached to the substrate 27 via diffusion bonding means, electro-deposition means, standard printed circuit means, etching means, adhesive means, mechanical attachment means (e.g., non-conductive fasteners), or plating means. In an embodiment, the second conductive material is comprised of a conductive metal or alloy. In another embodiment, the second conductive material may be selected from a group consisting of aluminum, copper, brass, gold, silver, tin, and nickel. In an embodiment, the ground plane 26 has an ellipsoidal, rectilinear, arbitrary, or asymmetrical crosssectional shape with a predetermined thickness.

Figure 3B:
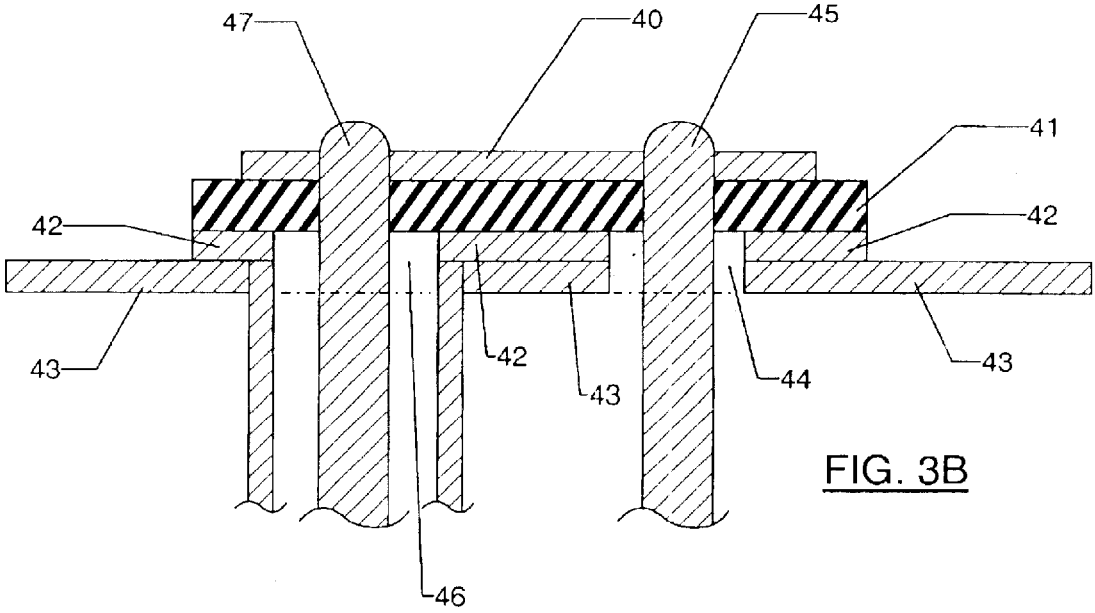
FIG. 3B. is a cross sectional view of one embodiment of an integrated circuit, patch element, and novel feed structure.

With continued reference to FIG. 3A, there is an integrated circuit formed of a circuit layer 29 and a laminate layer 34 wherein the integrated circuit is attached to the patch element 28. The integrated circuit, for example, manipulates an electromagnetic signal, which is fed to the integrated circuit through a feed means (discussed later). The integrated circuit may be attached to the patch element 28 through electrically bonded means, adhesive means, or mechanical attachment means. Further, the integrated circuit is electrically connected to the patch element 28 at or near the feed means and electrical connection means 33 (discussed later). Multiple embodiments for the integrated circuit exist. In one embodiment, the integrated circuit is formed of circuit board material or similar. In a second embodiment, the integrated circuit may be selected from a group consisting of a filter, power divider, amplifier, phase shifter, and transmission line. In a third embodiment, the integrated circuit may be a stripline circuit. In a fourth embodiment, the integrated circuit may be a microstrip line circuit. In a fifth embodiment, the integrated circuit may be formed of active components, passive components, or both. Further, as illustrated in FIG. 3B, in another embodiment, the integrated circuit is formed of a circuit layer 40, a laminate layer 41, and a ground layer 42, wherein the ground layer 42 is electrically connected to a patch element 43. In this embodiment, a first clearance 44 is created in the ground layer 42 and patch element 43 so that an electrical connection means 45 does not create a short circuit between the circuit layer 40 and the ground layer 42, patch element 43, or both. In this embodiment, a second clearance 46 is created in the ground layer 42 and patch element 43 so that an inner conductor 47 does not create a short circuit between the circuit layer 40 and the ground layer 42, patch element 43, or both. In this embodiment, the ground layer 42 is considered an extension of the patch element 43 wherein employment of the ground layer 42 may aid in the fabrication of the antenna. In yet another embodiment (not shown), the integrated circuit may be formed of a plurality of circuit layers, a plurality of laminate layers, and a ground layer. In a still another embodiment (not shown), the integrated circuit may be formed of a circuit layer, a laminate layer, and a patch element.

With continued reference to FIG. 3A, there is shown an electrical connection means 33 for electrically connecting the integrated circuit to a conductive component such as the ground plane 26 shown in FIG. 3A or a patch element in a layered antenna (not shown). With continued reference to FIG. 3A, the electrical connection means 33 excites the resonant fields between the patch element 28 and ground plane 26. In one embodiment, the electrical connection means is located at a predetermined position 32. The positioning of the electrical connection means determines the impedance of the antenna 25 in the same fashion commonly employed in traditional microstrip or layered antenna with coaxial feeds. A plated via or similar manual via, eyelet, pin, or wire are electrical connection means for electrically connecting the integrated circuit to a conductive component such as a ground plane, patch element, or similar. A cut-in portion corresponding to the diameter of the electrical connection means 33 may be incorporated in the substrate 27. In one embodiment (not shown), the electrical connection means may be secured on both ends by electrically bonded joints. In another embodiment (not shown), multiple electrical connection means may be used to achieve circular polarization (for example, wherein the integrated circuit may be a power divider) wherein the multiple electrical connection means are positioned at predetermined locations. In still another embodiment, the electrical connection means for electrically connecting the integrated circuit to a conductive component such as the ground plane, patch element, or similar is a plurality of plated vias or similar manual vias, eyelets, pins, or wires. Referring back to FIG. 3A, a first clearance 37 is created such that the electrical connection means does not create a short circuit between the patch element 28 and the ground plane 26.

With continued reference to FIG. 3A, there is shown a feed means for transferring electrical energy from a device (not shown) to a patch element and integrated circuit or vice versa or both. In one embodiment, a feed means for transferring electrical energy from a device (not shown) to a patch element and integrated circuit or vice versa or both is formed of an outer conductor 36 and an inner conductor 31. In one embodiment of a novel feed structure, the outer conductor 36 is electrically connected to and extends through the ground plane 26, wherein the outer conductor 36 is electrically connected to, attached to, and terminates at the patch element 28 on a first end of the outer conductor 36, wherein a second end of the outer conductor 36 is electrically connected to a device (not shown) or available for electrical connectivity, wherein the inner conductor 31 is electrically connected to, attached to, and terminates at the integrated circuit on a first end of the inner conductor, wherein the inner conductor extends through the ground plane 26, substrate 27, and patch element 28 but is not electrically connected to the ground plane 26 and patch element 28, wherein a second end of the inner conductor 31 is electrically connected to a device (not shown) or available for electrical connectivity, and wherein the outer conductor 36 concentrically surrounds the inner conductor 31 from about the second end of the inner conductor 31 to the patch element 28. With further reference to FIG. 3A, the integrated circuit is formed of a laminate layer 34 and a circuit layer 29, wherein the inner conductor 31 extends through the ground plane 26, substrate 27, patch element 28, and laminate layer 34, ultimately terminating on a first end of the inner conductor 31 at the circuit layer 29 of the integrated circuit. In this embodiment, the inner conductor 31 is not electrically connected to the ground plane 26 or to the patch element 28 and is electrically connected to the circuit layer 29. Further, in this embodiment, the outer conductor 36 extends through the ground plane 26 and substrate 27, while ultimately terminating at the patch element 28 on a first end of the outer conductor 36. In this embodiment, the outer conductor 36 is electrically connected to the ground plane 26 and the patch element 28. Further, the feed means may be positioned where the magnitude of the antenna's resonant electric field structure, in the absence of the feed means, is about zero 30, as illustrated in FIG. 3A. The resonant electric field structure may be equivalent to other terminology known in the art such as "electric field structure of the antenna" or "standing wave." Positioning of the feed means where the magnitude of the antenna's resonant electric field structure, in the absence of the feed means, is about zero minimizes the effect of a short circuit created by the outer conductor 36 of the feed means between the patch element 28 and the ground plane 26. In resonant antennas with geometries that are mathematically separable, a closed-form expression often exists for the electric field within the resonant structure. One example of this is the traditional half-wave rectangular microstrip patch in which the resonant electric field ($TM_{mn}$ mode) can be approximated by the function:

$$E_z = A\cos(m\,\pi x/b)\cos(n\pi y/c)$$

where A is a constant scalar, $E_z$ is the z-directed component of the electric field (the zvector is normal to the patch), and the origin is at a corner of the patch. Further, m and n are integer mode numbers that range from 0 to infinity. Also, the dimensions of the patch in the x-direction and y-direction are b and c, respectively. As is often done, the x- and y-directed components, representing the lateral directions on the patch, of the electric field are assumed zero beneath the patch element. For the dominant $TM_{10}$ mode, the electric field is zero along the plane x=b/2 within the confines of the patch element and the ground plane. Similarly, in resonant antennas with circular geometry, the zeroes of the electric field are given by zeroes of a Bessel function, a trigonometric function, derivatives of these functions, or some combination of these functions and their derivatives. In other types of resonant antennas, a zero point for the electric field is established by the introduction of a shorting pin, strip, via, or plated thru-hole. One example is the traditional quarter-wave microstrip patch, and another is the Planar Inverted-F Antenna (PIFA). For these antennas, either all or part of the intentional shorting device (i.e., pin, strip, via, or plated thru-hole) may be replaced by the short circuit established by the feed means described herein. A coaxial line is one feed means for transferring electrical energy from a device (not shown) to a patch element arid integrated circuit or vice versa or both. With continued reference to FIG. 3A, a coaxial line has an outer conductor 36 and inner conductor 31. Other feed means for transferring electrical energy from a device (not shown) to a patch element and integrated circuit or vice versa or both include a coaxial cable, hollow waveguide, a tri-axial waveguide, a shielded twinline, and an outer conductor with a plurality of inner conductors. In an ideal case, the diameter of the outer conductor is zero, and there is no net electrical effect to the antenna. In reality, the diameter of the outer conductor is not zero and its finite diameter slightly shifts or perturbs the resonant frequency. This shift is easily adjusted by tuning the length of the antenna. When the intrusion of the feed means is placed at a zero of the magnitude of the resonant electric field structure, the resonant frequency shifts upward as predicted by cavity perturbation theory. In some designs, the patch element and ground plane are intentionally shorted with a post so as to shift the resonant frequency by a predetermined amount or to introduce a reactance at the post location. The feed means described herein may also be used to affect this resonance shift or to introduce a reactive load if so desired. In one embodiment, the coaxial cable may be a semi-rigid coaxial cable. In a further embodiment, the coaxial cable may be a flexible coaxial cable. In a third embodiment, the outer conductor 36 of a coaxial line may be a plated via. In a fourth embodiment, the outer conductor 36 of a coaxial line may be a manual via. In an embodiment, an electrically bonded joint may be used to secure the inner conductor 31 to an integrated circuit, for example, to a circuit layer 29 such as the one illustrated in FIG. 3A. In another embodiment, an electrically bonded joint may be used to secure the outer conductor 36 to the patch element 28. In a third embodiment (not shown), the feed means may be electrically connected to a transmission line of an integrated circuit. In a fourth embodiment (not shown), the inner conductor 31 may be electrically connected to a transmission line of the integrated circuit. In a fifth embodiment (not shown), a dielectric spacer sandwiched between the outer conductor 36 and the inner conductor 31 may be used.

Figure 7:
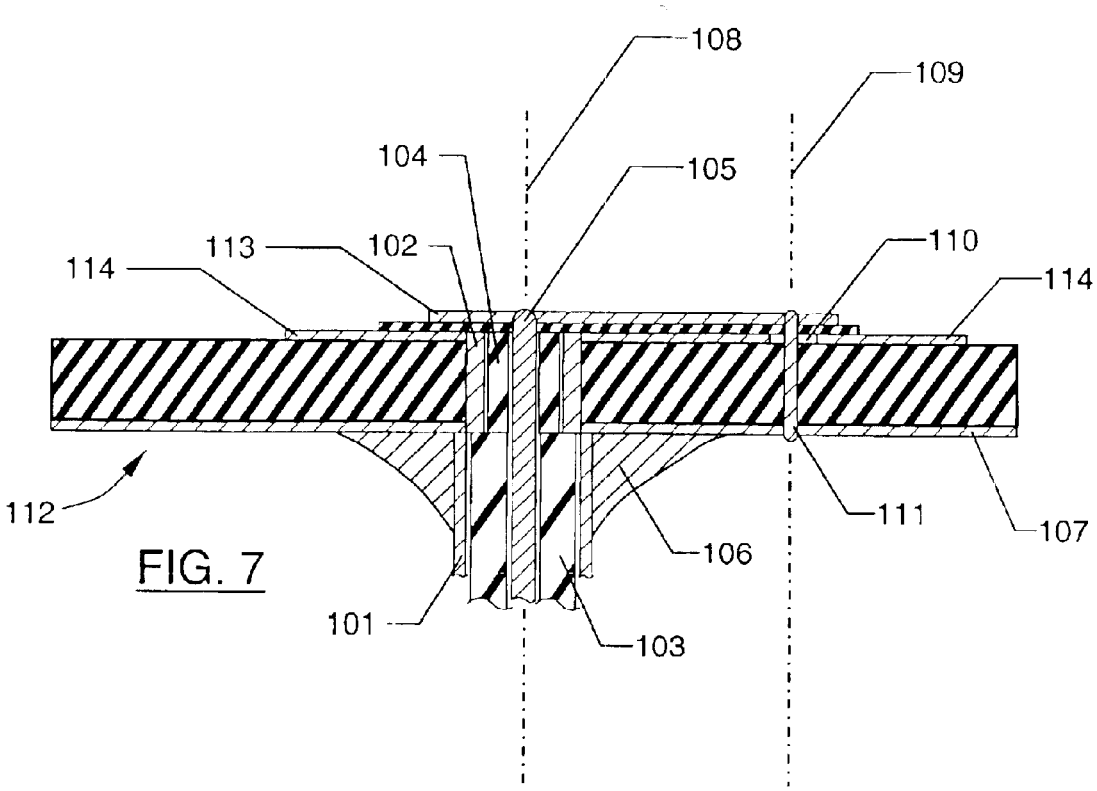
FIG. 7 is a cross sectional view of another embodiment of an antenna utilizing a novel feed structure wherein the feed means is formed of a first coaxial line and a second coaxial line.

Referring now to FIG. 7, there is shown another embodiment of an antenna 112, incorporating a novel feed structure, having yet another embodiment for a feed means for transferring electrical energy from a device (not shown) to a patch element and integrated circuit or vice versa or both. In this embodiment, the feed means for transferring electrical energy from a device (not shown) to a patch element and integrated circuit or vice versa or both is formed of a first coaxial line and a second coaxial line. In this embodiment, the first coaxial line is formed of a first outer conductor 101 wherein one end of the first outer conductor is electrically connected to a ground plane 107, an inner conductor 105 wherein one end of the inner conductor 105 is electrically connected to a circuit layer 113 of an integrated circuit, and a first dielectric spacer 103 sandwiched between the first outer conductor 101 and the inner conductor 105. The second end of the first outer conductor 101 and the second end of the inner conductor 105 are both available for electrical connectivity. In this embodiment, the second coaxial line is formed of a second outer conductor 102 wherein one end of the second outer conductor 102 is electrically connected to a patch element 114 and wherein the second end of the second outer conductor 102 is electrically connected to the ground plane 107, the inner conductor 105, and a second dielectric spacer 104 sandwiched between the second outer conductor 102 and the inner conductor 105. In this embodiment, the first coaxial line has a first characteristic impedance (Z1), which is determined by the diameter of the first outer conductor 101, a first relative permittivity ($\epsilon 1$) of the first dielectric spacer 103, and the diameter of the inner conductor 105. In this embodiment, the second coaxial line has a second characteristic impedance (Z2), which is determined by the diameter of the second outer conductor 102, a second relative permittivity ($\epsilon 2$) of the second dielectric spacer 104, and the diameter of the inner conductor 105. Z1 may or may not be equal to Z2and $\epsilon 1$ may or may not be equal to $\epsilon 2$. With continued reference to FIG. 7, the feed means is positioned where the magnitude of the resonant electric field structure, in the absence of the feed means, is about zero 108. In another embodiment, an at least one outer conductor, of a feed means, may be positioned to establish a null in the resonant electric field structure by creating a short circuit between the patch element and the ground plane. Further, the antenna 112 further comprises an electrical connection means 111 for electrically connecting the circuit layer 113 of the integrated circuit to the ground plane 107. The electrical connection means 111 extends through the patch element 114 through a clearance 110 in the patch element 114. The electrical connection means 111 is positioned at a predetermined location 109 on the antenna 112. Although an electrical connection means is illustrated in FIG. 7, a plurality of electrical connection means, one or more apertures, or any combination may be employed. In a second embodiment (not shown), a coaxial line formed of an outer conductor, an inner conductor, and a dielectric spacer is a feed means for transferring electrical energy from a device (not shown) to a patch element and integrated circuit or vice versa or both. In a third embodiment (not shown), an outer conductor, at least one inner conductor, and a dielectric spacer is a feed means for transferring electrical energy from a device (not shown) to a patch element and integrated circuit or vice versa or both. In a fourth embodiment (not shown), an outer conductor and at least one inner conductor is a feed means for transferring electrical energy from a device (not shown) to a patch element and integrated circuit or vice versa or both. In a fifth embodiment, at least one outer conductor, at least one inner conductor, and at least one dielectric spacer is a feed means for transferring electrical energy from a device (not shown) to a patch element and integrated circuit or vice versa or both. In an embodiment (not shown), a plurality of outer conductors may be arranged in a radial manner concentrically surrounding each other and may or may not be electrically connected to each other, arranged in a serial manner electrically connected to each other, or any combination. In this embodiment, an electrical path exists from one end of the plurality of outer conductors to the second end of the plurality of outer conductors. In an embodiment (not shown), a plurality of inner conductors may be arranged in a parallel manner and may or may not be electrically connected to each other, arranged in a serial manner electrically connected to each other, or any combination. In this embodiment, an electrical path exists from one end of the plurality of inner conductors to the second end of the plurality of inner conductors.

Referring now to FIG. 3A, there is shown a connection means 35 for connecting the feed means to a conductive component such as the ground plane 26. A coaxial cable connector is one connection means for connecting the feed means to the ground plane 26. Referring now to FIG. 7, there is shown an electrically bonded joint 106, which is another connection means for connecting the feed means to a conductive component such as a ground plane 107.

Figure 4:
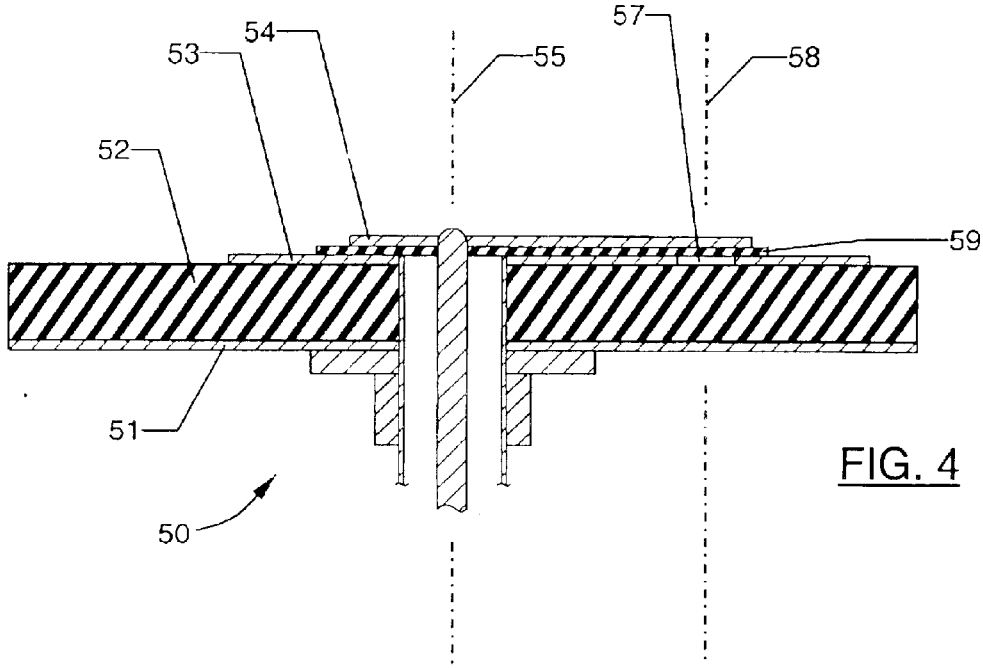
FIG. 4. is a cross sectional view of another embodiment of an antenna utilizing an aperture and a novel feed structure.

Referring now to FIG. 4, there is shown another embodiment of an antenna 50, incorporating a novel feed structure, formed of a substrate 52, patch element 53, ground plane 51, integrated circuit, an aperture 57, and a feed means. In this embodiment, the integrated circuit is formed of a circuit layer 54 and a laminate layer 59. Antenna 50 differs from antenna 25 in that antenna 50 the electrical connection means of antenna 25 (ref: element 33 in FIG. 3A) is replaced by an aperture 57. Construction of the aperture 57 may be formed in the patch element 53 by conventional methods such as press punching, etching, printed circuit means, or drilling. The position 58 of aperture 57 is predetermined. In one embodiment, the feed means is positioned where the magnitude of the antenna's resonant electric field structure, in the absence of the feed means, is about zero 55. In one embodiment, aperture 57 may have an ellipsoidal cross-sectional shape. In a further embodiment, aperture 57 may have a rectilinear cross-sectional shape. Substrate 52 is equivalent to substrate 27 and the above discussion as to substrate 27 is applicable to substrate 52. Patch element 53 is equivalent to patch element 28 and the above discussion as to patch element 28 is applicable to patch element 53. Ground plane 51 is equivalent to ground plane 26 and the discussion as to ground plane 26 is applicable to ground plane 51. The discussion as to the integrated circuit above is applicable to the integrated circuit in this paragraph. Feed means discussed in this paragraph encompasses the multiple feed means discussed above. The feed means may be positioned where the magnitude of the antenna's resonant electric field structure, in the absence of the feed means, is about zero 55. In one embodiment, the location of the integrated circuit at the top of the patch element 53 simplifies the design of stacked or layered antennas when the aperture 57 is utilized. Although one aperture is illustrated in FIG. 4, in another embodiment, multiple apertures are used (not shown). In still a further embodiment, a combination of apertures and electrical connection means are used (not shown).

Figure 5:
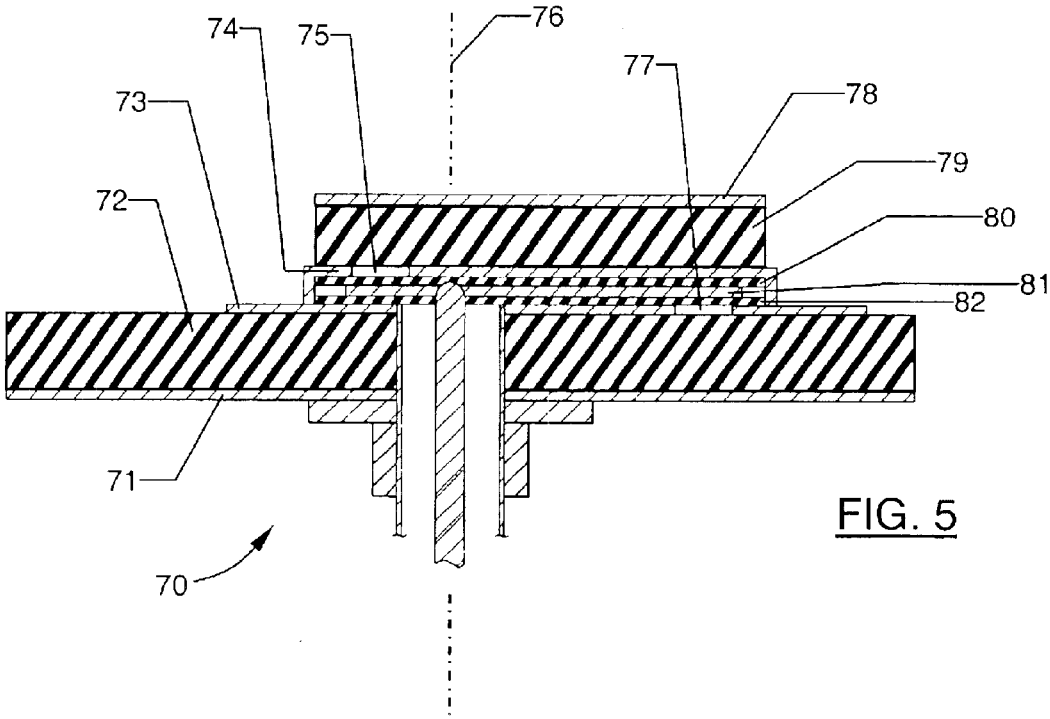
FIG. 5 is a cross sectional view of another embodiment of an antenna to show how a novel feed structure can be incorporated to form a layered antenna.

Referring now to FIG. 5, there is shown another embodiment of an antenna 70, incorporating a novel feed structure, comprising a first ground plane 71, a first substrate 72, a first patch element 73, a first aperture 77, an integrated circuit formed of a circuit layer 81 and a first laminate layer 82, a second laminate layer 80, a second ground plane 74, a second aperture 75, a second substrate 79, a second patch element 78, and a feed means. Antenna 70 is an example of a stacked or layered antenna and illustrates how a novel feed structure may be employed in this multi-layer fashion. Although a two-layer design is illustrated in FIG. 5, in another embodiment, a plurality of layers is used. Patch element 73 is equivalent to patch element 28 and the above discussion as to patch element 28 is applicable to patch element 73. Ground plane 71 is equivalent to ground plane 26 and the discussion as to ground plane 26 is applicable to ground plane 71. Integrated circuit discussed above is equivalent to the integrated circuit discussed in this paragraph. Feed means discussed in this paragraph encompasses the multiple feed means discussed above. The feed means may be positioned where the magnitude of the antenna's resonant electric field structure, in the absence of the feed means, is about zero 76. In one embodiment, multiple apertures incorporated in the first patch element, second ground plane, or both are used (as opposed to one aperture in the first patch element and one aperture in the second ground plane as illustrated in FIG. 5). In another embodiment a combination of electrical connection means and apertures are used (not shown). In still another embodiment, electrical connection means are used (not shown). In this embodiment an antenna is formed of a first ground plane, a first substrate, a first patch element, an integrated circuit, a laminate layer, a second ground plane, a second substrate, a second patch element, a first electrical connection means for electrically connecting the integrated circuit to the first ground plane, a second electrical connection means for electrically connecting the integrated circuit to the second patch element, and a feed means. Further, in this embodiment, the first electrical connection means extends through the first substrate at a predetermined position, wherein the first electrical connection means extends through the first patch element and is not electrically connected to the first patch element. In addition, in this embodiment, a second electrical connection means extends through the second substrate at a predetermined position, wherein the second electrical connection means extends through the laminate layer and second ground plane and is not electrically connected to the second ground plane. A plated via or similar, manual via, eyelet, pin, or wire arc means for electrically connecting the integrated circuit to the second patch element, first ground plane, or both.

With continued reference to FIG. 5, there is shown a first substrate 72 having a predetermined first dielectric constant. In one embodiment, the first dielectric constant may be from about 1 to about 200. There is also shown a second substrate 79 having a second dielectric constant. In one embodiment, the second dielectric constant may be from about 1 to about 200. In one embodiment, first substrate 72 has an ellipsoidal, rectilinear, arbitrary, or asymmetrical cross-sectional shape with a predetermined thickness. In a further embodiment, the second substrate 79 has an ellipsoidal, rectilinear, arbitrary, or asymmetrical cross-sectional shape with a predetermined thickness. As alluded to earlier, although two substrates are illustrated in FIG. 5, in another embodiment, three or more substrates are used for antenna layers greater than two.

Figure 8:
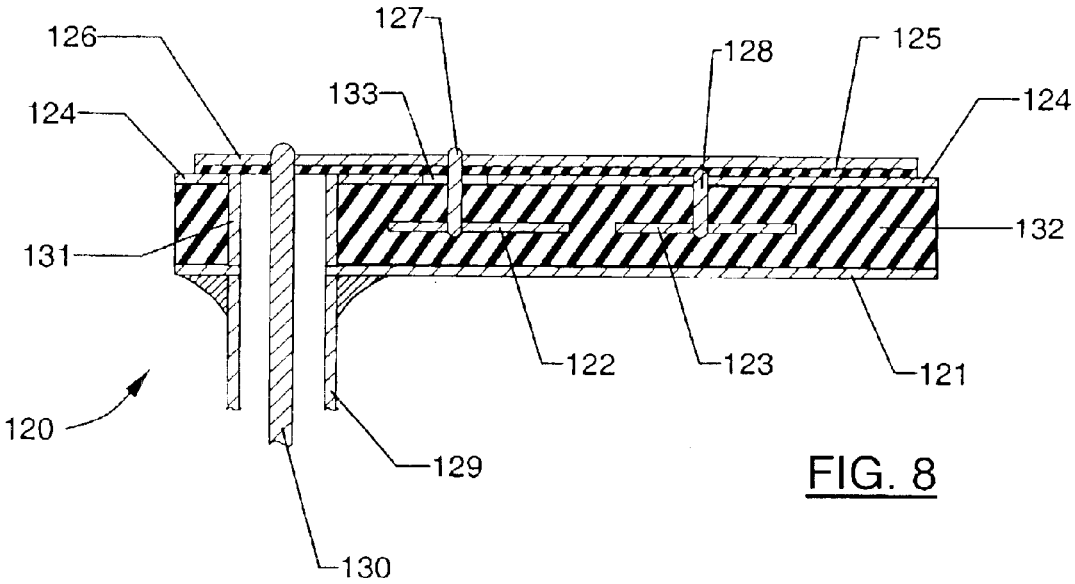
FIG. 8 is a cross sectional view of another embodiment of an antenna to show how a novel feed structure can be incorporated into a Planar Inverted-F Antenna (PIFA) with a capacitive feed and capacitive load.

Referring now to FIG. 8, there is shown another embodiment of antenna 120, incorporating a novel feed structure, comprising a ground plane 121, a capacitive feed plate 122, a capacitive load 123, a patch element 124, an integrated circuit formed of a laminate layer 125 and a circuit layer 126, a first electrical connections means 127 for electrically connecting the circuit layer 126 to the capacitive feed plate 122, a second electrical connection means 128 for electrically connecting the patch element 124 to the capacitive load 123, and a feed means formed of an first outer conductor 129, an inner conductor 130, and a second outer conductor 131. FIG. 8 illustrates how a novel feed structure is incorporated into a Planar Inverted-F Antenna (PIFA). In this embodiment, the first electrical connection means 127 extends through the patch element 124 through a clearance 133 but is not electrically connected to the patch element 124. In this embodiment, the first outer conductor 129 is electrically connected to and terminates at the ground plane 121 on a first end of the first outer conductor 129. The first outer conductor 129 is available for electrical connectivity on a second end of the first outer conductor 129. The inner conductor 130 terminates at the circuit layer 126 on a first end of the inner conductor 130. The inner conductor 130 is available for electrical connectivity on a second end of the inner conductor 130. The inner conductor 130 extends through the ground plane 121, substrate 132, and patch element 124 but is not electrically connected to the ground plane 121 and patch element 124. The second outer conductor 131 is electrically connected to and terminates at the patch element on a first end of the second outer conductor 131. The second outer conductor 131 is electrically connected to and terminates at the ground plane 121 on a second end of the second outer conductor 131. The second outer conductor 131 provides the short circuit, between the patch element 124 and the ground plane 121, that is required for the PIFA antenna. The second outer conductor of the feed means is positioned to establish the aforementioned short circuit, or null in the resonant electric field, at a predetermined location, the effects of said location are documented in the prior art. In one embodiment, one or more additional short circuits (not shown) may be inserted near the second conductor. In a second embodiment, a second outer conductor is contained entirely within a short circuit (not shown) of an arbitrary geometric cross-section. In one embodiment, the second outer conductor 131 is a plated thru-hole. In one embodiment, the first outer conductor 129 and inner conductor 130 is a coaxial cable. In a second embodiment, the second outer conductor 131 is an extension of the first outer conductor 129. Although one substrate 132 is illustrated in FIG. 8, two or more substrates may be used. For example, a capacitive feed plate and capacitive load may be attached to a bottom surface of a first substrate (not shown) and thereafter the bottom surface of the first substrate may be attached to a top surface of a second substrate (not shown). Substrate 132 is equivalent to substrate 27 and the above discussion as to substrate 27 is applicable to substrate 132. Patch element 124 is equivalent to patch element 28 and the above discussion as to patch element 28 is applicable to patch element 124. Ground plane 121 is equivalent to ground plane 26 and the discussion as to ground plane 26 is applicable to ground plane 121. The discussion as to the integrated circuit above is applicable to the integrated circuit in this paragraph.

In accordance with the invention, methods of use of the various embodiments of the novel feed structures and antennas described above are provided. The antenna devices described herein may be connected to a transmitter, receiver, or transceiver to broadcast, receive, or both, electromagnetic signals for the purpose of communication. For example, the novel feed structure simplifies the design and fabrication of a greatly miniaturized PIFA (Planar Inverted-F Antenna) with an integrated filter. It is known in the art that an increase in the bandwidth of an antenna typically requires an increase in the volume of the antenna, and also that the impedance bandwidth is typically much narrower than the gain bandwidth. The integrated circuit, described herein, can be a Tchebyscheff filter that greatly increases the impedance bandwidth of the antenna system, even though the filter represents a very small increase to the overall size. For example, the antenna as described in one embodiment herein is suitable for mounting on a cellular phone. Connecting a coaxial cable from the cellular phone's transceiver to a second end of the feed means described herein is accomplished. A feed means formed of an outer conductor and an inner conductor is used in this example. In essence, the aforementioned connection forms an electrical connection from the outer conductor of the cellular phone's coaxial cable to a ground plane of the antenna as well as to a patch element of the antenna (i.e., the metal forming the topside of the antenna). Further, this connection forms an electrical connection from the inner conductor of the cellular phone's coaxial cable to the integrated circuit. The cellular phone's coaxial cable becomes an integral part of the feed means as described herein. Relative to the feed means, the outer conductor of a coaxial connector is electrically connected to the ground plane side of the antenna. A coaxial cable, of gender opposite the connector, is fastened to the antenna connector on one side and to the transmitter, receiver, or transceiver on the second side. Energy through electromagnetic signals is coupled between the cellular phone's transceiver and the patch element by the feed means, integrated circuit, and electrical connection means. The integrated circuit performs a processing function for the signals either prior to, in the transmit case, or after, in the receive case, exciting the patch element. For example, in its simplest form, realized by a thru-line, the processing imparts a phase shift to the signals. In another embodiment, the processing may be dividing, in the transmit case, or combining, in the receive case, the power two or more ways and imparting a predetermined phase shift to each channel of the divided (or combined) power (e.g., A 2-way power divider followed by a 90 degree phase shift, with each channel feeding 1 or 2 spatially-orthogonal electrical connection means can be used to create a circularly polarized antenna.) The outer conductor of the feed means creates a short circuit between the patch element and the ground plane. Further, the outer conductor of the feed means serves to couple energy between the integrated circuit and the receiver, transmitter, or transceiver. The feed means may be positioned at a zero of the standing wave electric field to minimize the effects of the short circuit, or, as described herein, it may serve to intentionally impose a zero electric field boundary condition. In the former case, the primary objective of the feed means is to couple energy to the integrated circuit, and the placement is chosen to minimize the effects of a short between the patch element (topside metal) and the ground. In the latter case, the feed means serves dual purposes; i.e., coupling energy between the external transceiver and the integrated circuit as well as providing a zero electric field boundary condition. As an example, wherein the cellular phone's transceiver functions as a transmitter, the supply of energy from the transceiver to the integrated circuit and patch element in combination with an electrical connection means or aperture described above, results in a standing wave electric field created between the patch element and the ground plane. Near the edges of the patch element, the electric field is not fully-contained. This lack of containment results in fringing fields, which are the source of radiation of energy into the outside environment. Thus, energy is transferred from the transceiver to the outside environment for ultimate reception by a receiving source. As is well known in the art, the capability of the patch element to function as a receive antenna is fully described by electromagnetic reciprocity; that is, its receive radiation pattern at any selected frequency is the same as its transmit radiation pattern at the same selected frequency when the antenna is constructed of linear isotropic matter. The effects of the integrated circuit upon the capability of the system (i.e., patch element and integrated circuit) to function effectively in conjunction with either a transmitter, receiver, or both, are well known to those skilled in the art. Consistent with this prior knowledge, these effects may be considered in the design of the integrated circuit, of the antenna described herein, to permit use of the antenna to transmit, receive, or simultaneously transmit and receive electromagnetic radiation.

There are a number of other conceivable communication/telemetry applications for the antenna, including both digital and analog systems. For example, the antenna may be mounted in or on a laptop computer and connected, via the feed means, to a Wireless Ethernet card. In this manner, the antenna could be used for relaying Internet data. The antenna, incorporating a novel feed structure, is not limited to communication applications. For example, the antenna may also be used to transfer signals between a radar system and a target. It may also be used to apply electromagnetic energy for the purpose of heating or curing materials, or for receiving passive electromagnetic radiation ("blackbody" radiation) from materials. As stated earlier, some of the many advantages of the antennas described herein are the versatility in possible geometries including low-profile, planar shapes; lightweight construction; suitability for incorporation of integrated circuits; and low-cost manufacturing.

That which is claimed is:

1. A feed structure, for an antenna having a resonant electric field structure, comprising:

a patch element;

an integrated circuit attached to the patch element;

at least one inner conductor electrically connected to and terminating at the integrated circuit on a first end of the at least one inner conductor, wherein the at least one inner conductor extends through and is not electrically connected to the patch element, and wherein the at least one inner conductor is available for electrical connectivity on a second end of the at least one inner conductor; and at least one outer conductor electrically connected to and terminating at the patch element on a first end of the at least one outer conductor, wherein the at least one outer conductor is available for electrical connectivity on a second end of the at least one outer conductor, and wherein the at least one outer conductor concentrically surrounds the at least one inner conductor from the second end of the at least one inner conductor to the first end of the at least one outer conductor.

2. The feed structure according to claim 1, wherein the at least one outer conductor and the at least one inner conductor are positioned where the magnitude of the antenna's resonant electric field structure, in the absence of the at least one outer conductor and the at least one inner conductor, is about zero.

3. The feed structure according to claim 1, wherein the at least one outer conductor is positioned to establish a null in the resonant electric field structure by creating a short circuit between the patch element and a ground plane.

4. The feed structure according to claim 1, wherein the integrated circuit processes electrical energy to excite the patch element when transmitting or processes electrical energy excited in the integrated circuit by the patch element when receiving.

5. The feed structure according to claim 1, wherein the integrated circuit comprises a power divider for dividing power into two or more paths with each of the two or more paths imparting a predetermined phase shift and each of the two or more paths exciting the patch element at a different section of the patch element for the purpose of transmitting a circularly polarized elecromagnetic wave or for combining power from two more paths with each of the two or more paths having been excited from a different section of the patch element and each of the two or more paths imparting a pre-determined phase shift for the purpose of receiving a circularly polarized electromagnetic wave.

6. The feed structure according to claim 1, further comprising at least one dielectric spacer sandwiched between the at least one outer conductor and the at least one inner conductor from the second end of the at least one inner conductor to the first end of the outer conductor.

7. An antenna having a resonant electric field structure comprising:

a patch element;

a ground plane connected to the patch element wherein a gap exists between the patch element and ground plane;

an integrated circuit attached to the patch element;

an inner conductor electrically connected to and terminating at the integrated circuit on a first end of the inner conductor, wherein the inner conductor is available for electrical connectivity on a second end of the inner conductor, wherein the inner conductor extends through the ground plane and patch element but is not electrically connected to the ground plane and patch element; and an outer conductor electrically connected to and terminating at the patch element on a first end of the outer conductor, wherein the outer conductor is electrically connected to the ground plane, wherein the outer conductor is available for electrical connectivity on a second end of the outer conductor, and wherein the outer conductor concentrically surrounds the inner conductor from the second end of the inner conductor to the patch element.

8. The antenna according to claim 7, wherein the inner conductor and the outer conductor are positioned where the magnitude of the resonant electric field structure, in the absence of the inner conductor and the outer conductor, is about zero.

9. The antenna according to claim 7, wherein the outer conductor is positioned to establish a null in the resonant electric field structure by creating a short circuit between the patch element and the ground plane.

10. The antenna according to claim 7, wherein the integrated circuit processes electrical energy to excite the patch element when transmitting or processes electrical energy excited in the integrated circuit by the patch element when receiving.

11. The antenna according to claim 7, wherein the integrated circuit comprises a power divider for dividing power into two or more paths with each of the two or more paths imparting a pre-determined phase shift and each of the two or more paths exciting the patch element at a different section of the patch element for the purpose of transmitting a circularly polarized elecromagnetic wave or for combining power from two more paths with each of the two or more paths having been excited from a different section of the patch element and each of the two or more paths imparting a pre-determined phase shift for the purpose of receiving a circularly polarized electromagnetic wave.

12. The antenna according to claim 7, wherein the ground plane is connected to the patch element by non-conductive fasteners in such a manner wherein the gap is defined by a predetermined distance between the patch element and ground plane.

13. An antenna having a resonant electric field structure comprising:

a patch element;

a ground plane connected to the patch element wherein a gap exists between the patch element and ground plane;

an integrated circuit attached to the patch element;

at least one inner conductor electrically connected to and terminating at the integrated circuit on a first end of the at least one inner conductor, wherein the at least one inner conductor is available for electrical connectivity on a second end of the at least one inner conductor, wherein the at least one inner conductor extends through the ground plane and patch element but is not electrically connected to the ground plane and patch element, and wherein the at least one inner conductor forms an electrical path from the second end of the at least one inner conductor to the integrated circuit; and at least one outer conductor electrically connected to and terminating at the patch clement on a first end of the at least one outer conductor, wherein the at least one outer conductor is electrically connected to the ground plane, wherein the at least one outer conductor is available for electrical connectivity on a second end of the at least one outer conductor, wherein the at least one outer conductor concentrically surrounds the at least one inner conductor from the second end of the at least one inner conductor to the patch element, and wherein the at least one outer conductor forms an electrical path from the second end of the at least one outer conductor available for electrical connectivity to the patch element.

14. The antenna according to claim 13, wherein the at least one inner conductor and the at least one outer conductor are positioned where the magnitude of the resonant electric field structure, in the absence of the at least one inner conductor and the at least one outer conductor, is about zero.

15. The antenna according to claim 13, wherein the at least one outer conductor is positioned to establish a null in the resonant electric field structure by creating a short circuit between the patch element and the ground plane.

16. The antenna according to claim 13, wherein the ground plane is connected to the patch element by non-conductive fasteners in such a manner wherein the gap is defined by a predetermined distance between the patch element and ground plane.

17. The antenna according to claim 13, wherein the integrated circuit is formed of a laminate layer attached to the patch element and a circuit layer attached to the laminate layer, wherein the at least one inner conductor extends through the laminate layer and the first end of the at least one inner conductor terminates at and is electrically connected to the circuit layer.

18. The antenna according to claim 17, wherein the circuit layer processes electrical energy to excite the patch element when transmitting or processes electrical energy excited in the integrated circuit by the patch element when receiving.

19. The antenna according to claim 17, wherein the circuit layer comprises a power divider for dividing power into two or more paths with each of the two or more paths imparting a pre-determined phase shift and each of the two or more paths exciting the patch element at a different section of the patch element for the purpose of transmitting a circularly polarized elecromagnetic wave or for combining power from two more paths with each of the two or more paths having been excited from a different section of the patch element and each of the two or more paths imparting a pre-determined phase shift for the purpose of receiving a circularly polarized electromagnetic wave.

20. The antenna according to claim 17, further comprising at least one electrical connection means for electrically connecting the circuit layer to the ground plane, wherein the at least one electrical connection means extends through and is not electrically connected to the patch element, and wherein the at least one electrical connection means is positioned at a predetermined location on the antenna.

21. The antenna according to claim 20, wherein the at least one electrical connection means extends through the patch element by means of at least one clearance in the patch element.

22. The antenna according to claim 13, wherein the integrated circuit is formed of a ground layer attached and electrically connected to the patch element, a laminate layer attached to the ground layer, and a circuit layer attached to the laminate layer, wherein the at least one inner conductor extends through and is not electrically connected to the ground layer, wherein the at least one inner conductor extends through the laminate layer and the first end of the at least one inner conductor terminates at and is electrically connected to the circuit layer.

23. The antenna according to claim 22, further comprising at least one electrical connection means for electrically connecting the circuit layer to the ground plane, wherein the at least one electrical connection means extends through the laminate layer, wherein the at least one electrical connection means extends through and is not electrically connected to the patch element and ground layer, and wherein the at least one electrical connection means is positioned at a predetermined location on the antenna.

24. The antenna according to claim 23, wherein the at least one electrical connection means extends through the patch element and ground layer by means of at least one clearance in the patch element and ground layer.

25. The antenna according to claim 13, further comprising at least one dielectric spacer sandwiched between the at least one outer conductor and the at least one inner conductor from the second end of the at least one inner conductor to the patch element.

26. The antenna according to claim 25, wherein the at least one outer conductor is formed of:

a first outer conductor attached and electrically connected to the ground plane on a first end of the first outer conductor, where the first outer conductor concentrically surrounds the at least one inner conductor from the second end of the at least one inner conductor available for electrical connectivity to the ground plane, and wherein the first outer conductor is available for electrical connectivity on a second end of the first outer conductor, and a second outer conductor attached and electrically connected to the ground plane on a first end of the second outer conductor, wherein the second outer conductor is attached and electrically connected to the patch element on a second end of the second outer conductor, wherein the second outer conductor concentrically surrounds the at least one inner conductor from the ground plane to the patch element, and wherein the at least one dielectric spacer is formed of:

a first dielectric spacer sandwiched between the first outer conductor and the at least one inner conductor, and a second dielectric spacer sandwiched between the second outer conductor and the at least one inner conductor.

27. An antenna having a resonant electric field structure comprising:

a substrate having a top surface, a bottom surface, a predetermined thickness, and a predetermined dielectric constant;

a patch element attached to the top surface of the substrate wherein the patch element is comprised of a first conductive material;

a ground plane attached to the bottom surface of the substrate, wherein the ground plane is comprised of a second conductive material;

an integrated circuit attached to the patch element;

at least one inner conductor electrically connected to and terminating at the integrated circuit on a first end of the at least one inner conductor, wherein the at least one inner conductor is available for electrical connectivity on a second end of the at least one inner conductor, wherein the at least one inner conductor extends through the ground plane, substrate, and patch element but is not electrically connected to the ground plane and patch element; and an outer conductor electrically connected to and terminating at the patch element on a first end of the outer conductor, wherein the outer conductor is electrically connected to and extends through the ground plane, wherein the outer conductor extends through the substrate, wherein the outer conductor is available for electrical connectivity on a second end of the outer conductor, and wherein the outer conductor concentrically surrounds the at least one inner conductor from the second end of the at least one inner conductor to the patch element.

28. The apparatus according to claim 27, wherein the at least one inner conductor and the outer conductor are positioned where the magnitude of the resonant electric field structure, in the absence of the at least one inner conductor and the outer conductor, is about zero.

29. The antenna according to claim 27, wherein the at least one outer conductor is positioned to establish a null in the resonant electric field structure by creating a short circuit between the patch element and the ground plane.

30. The antenna according to claim 27, further comprising at least one electrical connection means for electrically connecting the integrated circuit to the ground plane, wherein the at least one electrical connection means extends through the substrate and patch element, and wherein the at least one electrical connection means is not electrically connected to the patch element.

31. The antenna according to claim 27, wherein the predetermined dielectric constant is from about 1 to about 200.

32. The antenna according to claim 27, wherein the substrate has an ellipsoidal, rectilinear, arbitrary, or asymmetrical shape with a predetermined thickness.

33. The antenna according to claim 27, wherein the ground plane has an ellipsoidal, rectilinear, arbitrary, or asymmetrical shape with a predetermined thickness.

34. The antenna according to claim 27, wherein the patch element has an ellipsoidal, rectilinear, arbitrary, or asymmetrical shape with a predetermined thickness.

35. The antenna according to claim 27, wherein the ground plane is attached to the bottom surface of the substrate and the patch element is attached to the top surface of the substrate by diffusion bonding means, electrodeposition means, standard printed circuit means, etching means, adhesive means, mechanical attachment, or plating means.

36. An antenna having a resonant electric field structure comprising:

a substrate having a top surface, a bottom surface, a predetermined thickness, and a predetermined dielectric constant;

a patch element attached to the top surface of the substrate wherein the patch element is comprised of a first conductive material;

a ground plane attached the bottom surface of the substrate, wherein the ground plane is comprised of a second conductive material;

an integrated circuit attached to the patch element;

at least one inner conductor electrically connected to and terminating at the integrated circuit on a first end of the at least one inner conductor, wherein the at least one inner conductor is available for electrical connectivity on a second end of the at least one inner conductor, wherein the at least one inner conductor extends through the ground plane, substrate, and patch element but not electrically connected to the ground plane and patch element, and wherein the at least one inner conductor forms an electrical path from the second end of the at least one inner conductor available for electrical connectivity to the integrated circuit;

at least one outer conductor electrically connected to and terminating at the patch element on a first end of the at least one outer conductor, wherein the at least one outer conductor is available for electrical connectivity on a second end of the at least one outer conductor, wherein the at least one outer conductor is electrically connected to the ground plane, wherein the at least one outer conductor extends through the substrate, wherein the at least one outer conductor concentrically surrounds the at least one inner conductor from the second end of the at least one inner conductor available for electrical connectivity to the patch element, and wherein the at least one outer conductor forms an electrical path from the second end of the at least one outer conductor available for electrical connectivity to the patch element; and at least one dielectric spacer sandwiched between the at least one outer conductor and the at least one inner conductor from the second end of the at least one inner conductor available for electrical connectivity to the patch element.

37. The antenna according to claim 36, wherein the at least one outer conductor is formed of:

a first outer conductor attached and electrically connected to the ground plane on a first end of the first outer conductor, wherein the first outer conductor is available for electrical connectivity on a second end of the first outer conductor, wherein the first outer conductor concentrically surrounds the at least one inner conductor from the second end of the at least one inner conductor available for electrical connectivity to the ground plane, and a second outer conductor attached and electrically connected to the ground plane on a first end of the second outer conductor, wherein the second outer conductor is attached and electrically connected to the patch element on a second end of the second outer conductor, wherein the second outer conductor extends through the substrate and concentrically surrounding the at least one inner conductor from the ground plane to the patch element, and wherein the at least one dielectric spacer is formed of:

a first dielectric spacer sandwiched between the first outer conductor and the at least one inner conductor, and a second dielectric spacer sandwiched between the second outer conductor and the at least one inner conductor.

38. An antenna having a resonant electric field structure comprising:

a substrate having a top surface, bottom surface, predetermined thickness, and predetermined dielectric constant;

a patch element attached to the top surface of the substrate wherein the patch element is comprised of a first conductive material;

a ground plane attached the bottom surface of the substrate, wherein the ground plane is comprised of a second conductive material;

an integrated circuit attached to the patch element;

at least one electrical connection means for electrically connecting the integrated circuit to the ground plane wherein each electrical connection means extends through the substrate at a predetermined position, wherein each electrical connection means extends through the patch element but is not electrically connected to the patch element;

at least one inner conductor electrically connected to and terminating at the integrated circuit on a first end of the at least one inner conductor, wherein the at least one inner conductor is available for electrical connectivity on a second end of the at least one inner conductor, wherein the at least one inner conductor extends through the ground plane, substrate, and patch element but not electrically connected to the ground plane and patch element, and wherein the at least one inner conductor forms an electrical path from the second end of the at least one inner conductor available for electrical connectivity to the integrated circuit; and at least one outer conductor electrically connected to and terminating at the patch element on a first end of the at least one outer conductor, wherein the at least one outer conductor is electrically connected to the ground plane, wherein the at least one outer conductor extends through the substrate, wherein the at least one outer conductor concentrically surrounds the at least one inner conductor from the second end of at least one inner conductor available for electrical connectivity to the patch element, wherein the at least one outer conductor is available for electrical connectivity on a second end of the at least one outer conductor, and wherein the at least one outer conductor forms an electrical path from the second end of the at least one outer conductor available for electrical connectivity to the patch element.

39. The antenna according to claim 38, wherein the integrated circuit is attached to the patch element by electrically bonded means, adhesive means, or mechanical attachment means.

40. The antenna according to claim 38, wherein the integrated circuit is selected from a group consisting of a filter, power divider, amplifier, phase shifter, and transmission line.

41. The antenna according to claim 38, wherein the first conductive material of the patch element is a conductive metal or alloy.

42. The antenna according to claim 38, wherein the second conductive material of the ground plane is a conductive metal or alloy.

43. The antenna according to claim 38, wherein the first conductive material of the patch element is selected from the group consisting of aluminum, copper, brass, gold, silver, tin, and nickel.

44. The antenna according to claim 38, wherein the second conductive material of the ground plane is selected from the group consisting of aluminum, copper, brass, gold, silver, tin, and nickel.

45. The antenna according to claim 38, further comprising a connection means for connecting the at least one outer conductor to the ground plane.

46. The antenna according to claim 38, further comprising at least one dielectric spacer sandwiched between the at least one outer conductor and the at least one inner conductor.

47. An antenna having a resonant electric field structure comprising:

a substrate having a predetermined dielectric constant;

a patch element attached to the substrate;

a ground plane attached to the substrate, wherein the ground plane is comprised of a conductive material;

an integrated circuit attached to the patch element;

a via electrically connected to the integrated circuit and ground plane;

an inner conductor electrically connected to and terminating at the integrated circuit on a first end of the inner conductor, wherein the inner conductor is available for electrical connectivity on a second end of the inner conductor, wherein the inner conductor extends through the ground plane, substrate, and patch element but is not electrically connected to the ground plane or patch element, and wherein the at least one inner conductor forms an electrical path from the second end of the at least one inner conductor available for electrical connectivity to the integrated circuit; and an outer conductor electrically connected to and terminating at the patch element on a first end of the outer conductor, wherein the outer conductor is electrically connected to and extends through the ground plane, wherein the outer conductor extends through the substrate, wherein the outer conductor is available for electrical connectivity on a second end of the outer conductor, wherein the outer conductor concentrically surrounds the inner conductor from the second end of the inner conductor to the patch element, and wherein the outer conductor forms an electrical path from the second end of the at least one outer conductor available for electrical connectivity to the patch element.

48. The antenna according to claim 47, wherein the inner conductor and the outer conductor are positioned where the magnitude of the resonant electric field structure, in the absence of the outer conductor and the inner conductor, is about zero.

49. The antenna according to claim 47, wherein the outer conductor is positioned to establish a null in the resonant electric field structure by creating a short circuit between the patch element and the ground plane.

50. The antenna according to claim 47, wherein the via is a manual via.

51. The antenna according to claim 47, wherein the via is a plated via.

52. The antenna according to claim 47, wherein the integrated circuit is a stripline circuit.

53. The antenna according to claim 47, wherein the integrated circuit is a microstrip line circuit.

54. The antenna according to claim 47, further comprising a dielectric spacer sandwiched between the outer conductor and inner conductor from the second end of the inner conductor to the patch element.

55. An antenna, having a resonant electric field structure and electrically connected to a device, comprising:

a substrate having a predetermined dielectric constant;

a patch element attached to the substrate wherein the patch element incorporates at least one aperture at a predetermined location;

a ground plane attached to the substrate, wherein the ground plane is comprised of a conductive material;

an integrated circuit attached to the patch element; and a feed means for transferring electrical energy from the device to the patch element and integrated circuit or vice versa or both having at least one outer conductor and at least one inner conductor, wherein the at least one inner conductor is electrically connected to and terminates at the integrated circuit on a first end of the at least one inner conductor, wherein the at least one inner conductor is electrically connected to the device on a second end of the at least one inner conductor, wherein the at least one inner conductor extends through the ground plane, substrate, and patch element but is not electrically connected to the ground plane and patch element, wherein the at least one inner conductor forms an electrical path from the second end of the at least one inner conductor to the integrated circuit, wherein the at least one outer conductor is electrically connected to and terminates at the patch element on a first end of the at least one outer conductor, wherein the at least one outer conductor is electrically connected to the ground plane, wherein the at least one outer conductor extends through the substrate, wherein the at least one outer conductor is electrically connected to the device on a second end of the at least one outer conductor, wherein the at least one outer conductor concentrically surrounds the at least one inner conductor from the second end of the at least one inner conductor to the patch element, and wherein the at least one outer conductor forms an electrical path from the second end of the at least one outer conductor to the patch element.

56. The antenna according to claim 55, wherein the feed means is positioned where the magnitude of the resonant electric field structure, in the absence of the feed means, is about zero.

57. The antenna according to claim 55, wherein the at least one outer conductor is positioned to establish a null in the resonant electric field structure by creating a short circuit between the patch element and the ground plane.

58. The antenna according to claim 55, wherein each aperture has an ellipsoidal cross-sectional shape.

59. The antenna according to claim 55, wherein each aperture has a circular cross-sectional shape.

60. The antenna according to claim 55, wherein each aperture has a rectilinear cross-sectional shape.

61. The antenna according to claim 55, wherein each aperture is incorporated in the patch element by press punching means, etching means, printed circuit means, or drilling means.

62. The antenna according to claim 55, wherein the integrated circuit is formed of a laminate layer connected to the patch element and a circuit layer attached to the laminate layer.

63. An antenna, having a resonant electric field structure and electrically connected to a device, comprising:

a first substrate having a predetermined first dielectric constant;

a first ground plane attached to the first substrate;

a first patch element attached to the first substrate wherein the first patch element incorporates at least one first patch element (FPE) aperture;

an integrated circuit attached to the first patch element;

a second laminate layer attached to the integrated circuit;

a second ground plane attached to the second laminate layer wherein the second ground plane incorporates at least one second ground plane (SGP) aperture;

a second substrate having predetermined second dielectric constant attached to the second ground plane;

a second patch element attached to the second substrate; and a feed means for transferring electrical energy from the device to the first patch element and integrated circuit or vice versa or both having at least one outer conductor and at least one inner conductor, wherein the at least one inner conductor is electrically connected to and terminates at the integrated circuit at a first end of the at least one inner conductor, wherein the at least one inner conductor is electrically connected to the device on a second end of the at least one inner conductor, wherein the at least one inner conductor extends through the first ground plane, the first substrate, and the first patch element but is not electrically connected to the first ground plane and first patch element, wherein at the at least one inner conductor forms an electrical path from the second end of the at least one inner conductor to the integrated circuit, wherein the at least one outer conductor is electrically connected to and terminates at the first patch clement on a first end of the at least one outer conductor, wherein the at least one outer conductor is electrically connected to the first ground plane, wherein the at least one outer conductor extends through the first substrate, wherein the at least one outer conductor is electrically connected to the device on a second end of the at least one outer conductor, wherein the at least one outer conductor concentrically surrounds the at least one inner conductor from the second end of at least one inner conductor to the first: patch element, and wherein at the at least one outer conductor forms an electrical path from the second end of the at least one outer conductor to the first patch element.

64. The antenna according to claim 63, wherein the integrated circuit is formed of a first laminate layer attached to the first patch element and a circuit layer attached to the first laminate layer.

65. An antenna, having a resonant electric field structure and electrically connected to a device, comprising:

a first substrate having a predetermined first dielectric constant;

a first ground plane attached to the first substrate;

a first patch element attached to the first substrate wherein the first patch element incorporates an aperture;

an integrated circuit attached to the first patch element;

a laminate layer attached to the integrated circuit;

a second ground plane attached to the laminate layer, a second substrate having predetermined second dielectric constant attached to the second ground plane;

a second patch element attached to the second substrate;

at least one electrical connection means for electrically connecting the integrated circuit to the second patch element wherein the at least one electrical connection means extends through the second substrate at a predetermined position, wherein the at least one electrical connection means extends through the second ground plane and is not electrically connected to the second ground plane, and wherein the at least one electrical connection means extends through the laminate layer; and a feed means for transferring electrical energy from the device to the first patch element and integrated circuit or vice versa or both having at least one outer conductor and at least one inner conductor, wherein the at least one inner conductor is electrically connected to and terminates at the integrated circuit on a first end of the at least one inner conductor, wherein the at least one inner conductor is electrically connected to the device on a second end of the at least one inner conductor, wherein the at least one inner conductor extends through the first ground plane, the first substrate, and the first patch element but is not electrically connected to the first ground plane and first patch element, wherein the at least one inner conductor forms an electrical path from the second end of at least one inner conductor to the integrated circuit, wherein the at least one outer conductor is electrically connected to and terminates at the first patch element on a first end of the at least one outer conductor, wherein the at least one outer conductor is electrically connected to the first ground plane, wherein the at least one outer conductor extends through the first substrate, wherein the at least one outer conductor is electrically connected to the device on a second end of the at least one outer conductor, wherein the at least one outer conductor concentrically surrounds the at least one inner conductor from the second end of the at least one inner conductor to the first patch element, and wherein the at least one outer conductor forms an electrical path from the second end of the at least one outer conductor to the first patch element.

66. An antenna, having a resonant electric field structure and electrically connected to a device, comprising:

a first substrate having a predetermined first dielectric constant;

a first ground plane attached to the first substrate;

a first patch element attached to the first substrate;

an integrated circuit attached to the first patch element;

a laminate layer attached to the integrated circuit;

a second ground plane attached to the laminate layer wherein the second ground plane incorporates at least one aperture;

a second substrate having predetermined second dielectric constant attached to the second ground plane;

a second patch element attached to the second substrate;

at least one electrical connection means for electrically connecting the integrated circuit to the first ground plane wherein the at least one electrical connection means extends through the first substrate at a predetermined position, and wherein the at least one electrical connection means extends through the first patch element and is not electrically connected to the first patch element; and a feed means for transferring electrical energy from the device to the patch element and integrated circuit or vice versa or both having at least one outer conductor and at least one inner conductor, wherein the at least one inner conductor is electrically connected to and terminates at the integrated circuit on a first end of the at least one inner conductor, wherein the at least one inner conductor is electrically connected to the device on a second end of the at least one inner conductor, wherein the at least one inner conductor extends through the first ground plane, the first substrate, and the first patch element but is not electrically connected to the first ground plane and first patch clement, wherein the at least one inner conductor forms an electrical path from the second end of the at least one inner conductor to the integrated circuit, wherein the at least one outer conductor is electrically connected to and terminates at the first patch element on a first end of the at least one outer conductor, wherein the at least one outer conductor is electrically connected to the first ground plane, wherein the at least one outer conductor extends through the first substrate, wherein the at least one outer conductor is electrically connected to the device on a second end of the at least one outer conductor, wherein the at least one outer conductor concentrically surrounds the at least one inner conductor from the second end of the at least one inner conductor to the first patch element, and wherein the at least one outer conductor forms an electrical path from the second end of the at least one outer conductor to the first patch element.

67. An antenna, having a resonant electric field structure and electrically connected to a device, comprising:

a first substrate having a predetermined first dielectric constant;

a first ground plane attached to the first substrate;

a first patch clement attached to the first substrate;

an integrated circuit attached to the patch element;

a laminate layer attached to the integrated circuit;

a second ground plane attached to the laminate layer;

a second substrate having predetermined second dielectric constant attached to the second ground plane layer;

a second patch element attached to the second substrate;

at least one first electrical connection means for electrically connecting the integrated circuit to;the first ground plane wherein the at least one first electrical connection means extends through the first substrate at a predetermined position, and wherein the at least one first electrical connection means extends through the first patch element and is not electrically connected to the first patch element;

at least one second electrical connection means for electrically connecting the integrated circuit to the second patch element wherein the at least one second electrical connection means extends through the second substrate at a predetermined position, wherein the at least one second electrical connection means extends through the second ground plane and is not electrically connected to the second ground plane, and wherein the at least one second electrical connection means extends through the laminate layer; and a feed means for transferring electrical energy from the device to the first patch element and integrated circuit or vice versa or both having at least one outer conductor and at least one inner conductor, wherein the at least one inner conductor is electrically connected to and terminates at the integrated circuit on a first end of the at least one inner conductor, wherein the at least one inner conductor is electrically connected to the device on a second end of the at least one inner conductor, wherein the at least one inner conductor extends through the first ground plane, the first substrate, and the first patch element but is not electrically connected to the first ground plane and first patch element, wherein the at least one inner conductor forms an electrical path from the second end of the at least one inner conductor to the integrated circuit, wherein the at least one outer conductor is electrically connected to and terminates at the first patch element on a first end of the at least one outer conductor, wherein the at least one outer conductor is electrically connected to the first ground plane, wherein the at least one outer conductor extends through the first substrate, wherein the at least one outer conductor is electrically connected to the device on a second end of the at least one outer conductor, wherein the at least one outer conductor concentrically surrounds the at least one inner conductor from the second end of the at least one inner conductor to the first patch element, and wherein the at least one outer conductor forms an electrical path from the second end of the at least one outer conductor to the first patch element.

68. An antenna, having a resonant electric field structure and electrically connected to a device, comprising:

a substrate having a predetermined first dielectric constant;

a ground plane attached to the substrate;

a patch element attached to the substrate;

an integrated circuit attached to the patch element;

a capacitive feed plate embedded in the substrate;

a capacitive load embedded in the substrate;

a first electrical connection means for electrically connecting the integrated circuit to the capacitive feed plate wherein the first electrical connection means extends through the first substrate at a predetermined position, and wherein the first electrical connection means extends through the patch element and is not electrically connected to the patch element;

a second electrical connection means for electrically connecting the patch element to the capacitive load wherein the second electrical connection means extends through the substrate at a predetermined position; and a feed means for transferring electrical energy from the device to the patch element and integrated circuit or vice versa or both having at least one outer conductor and at least one inner conductor, wherein the at least one inner conductor is electrically connected to and terminates at the integrated circuit on a first end of the at least one inner conductor, wherein the at least one inner conductor is electrically connected to the device on a second end of the at least one inner conductor, wherein the at least one inner conductor extends through the ground plane, the substrate, and the patch element but is not electrically connected to the ground plane and patch element, wherein the at least one inner conductor forms an electrical path from the second end of the at least one inner conductor to the integrated circuit, wherein the at least one outer conductor is electrically connected to and terminates at the patch element on a first end of the at least one outer conductor, wherein the at least one outer conductor is electrically connected to the first ground plane, wherein the at least one outer conductor extends through the first substrate, wherein the at least one outer conductor is electrically connected to the device on a second end of the at least one outer conductor, wherein the at least one outer conductor concentrically surrounds the at least one inner conductor from the second end of the at least one inner conductor to the first patch element, and wherein the at least one outer conductor forms an electrical path from the second end of the at least one outer conductor to the first patch element.

69. The antenna according to claim 68, wherein the at least one outer conductor is positioned to establish a null in the resonant electric field structure by creating a short circuit between the patch element and the ground plane.

70. The antenna according to claim 68, wherein the at least one outer conductor is formed of:

a first outer conductor attached and electrically connected to the ground plane on a first end of the first outer conductor, wherein the first outer conductor is electrically connected to the device on a second end of the first outer conductor, wherein the first outer conductor concentrically surrounds the at least one inner conductor from the second end of the at least one inner conductor to the ground plane, and a second outer conductor attached and electrically connected to the ground plane on a first end of the second outer conductor, wherein the second outer conductor is attached and electrically connected to the patch element on a second end of the second outer conductor, wherein the second outer conductor extends through the substrate and concentrically surrounding the at least one inner conductor from the ground plane to the patch element.

* * * * *